US007413499B2

(12) United States Patent
Noda

(10) Patent No.: US 7,413,499 B2
(45) Date of Patent: Aug. 19, 2008

(54) GRINDING PROCESS AND APPARATUS WITH ARRANGEMENT FOR GRINDING WITH CONSTANT GRINDING LOAD

(75) Inventor: Kenji Noda, Nagoya (JP)

(73) Assignee: Noritake Co., Limited, Nagoya (JP)

( * ) Notice: Subject to any disclaimer, the term of this patent is extended or adjusted under 35 U.S.C. 154(b) by 407 days.

(21) Appl. No.: 11/236,825

(22) Filed: Sep. 28, 2005

(65) Prior Publication Data

US 2006/0073765 A1 Apr. 6, 2006

(30) Foreign Application Priority Data

Oct. 1, 2004 (JP) ..... 2004-290592

(51) Int. Cl.
*B24B 1/00* (2006.01)
*B24B 49/00* (2006.01)
*B24B 51/00* (2006.01)

(52) U.S. Cl. ..... 451/5; 340/680; 451/8; 451/9; 451/10; 451/63; 700/301; 700/305; 700/306

(58) Field of Classification Search ..... 451/5, 451/8, 9, 10, 11, 63; 340/680; 700/301, 700/305, 306
See application file for complete search history.

(56) References Cited

U.S. PATENT DOCUMENTS 3,818,642 A * 6/1974 Seidel ..... 451/5
4,428,162 A * 1/1984 Feldt et al. ..... 451/5
4,570,385 A * 2/1986 Richter et al. ..... 451/5
5,194,126 A * 3/1993 Packalin ..... 205/663
5,562,525 A * 10/1996 Mori et al. ..... 451/5
6,113,474 A * 9/2000 Shih et al. ..... 451/72
7,089,081 B2 * 8/2006 Palmgren ..... 700/175
7,118,446 B2 * 10/2006 Walsh et al. ..... 451/5
7,314,401 B2 * 1/2008 Chandrasekaran ..... 451/10
2004/0198196 A1 * 10/2004 Walsh et al. ..... 451/58
2007/0128983 A1 * 6/2007 Walsh et al. ..... 451/5

FOREIGN PATENT DOCUMENTS

JP A 08-276349 10/1996
JP A-11-309664 11/1999
JP A-2000-317830 11/2000
JP A-2001-358104 12/2001
JP A-2002-028860 1/2002

* cited by examiner

*Primary Examiner*—Timothy V Eley
(74) *Attorney, Agent, or Firm*—Oliff & Berridge, PLC

(57) ABSTRACT

A process of grinding a surface of a workpiece, by a grinding tool rotated about its axis. The process includes a grinding step of grinding the workpiece surface, by pressing at least one of the grinding tool and the workpiece against the other of the grinding tool and the workpiece, such that a constant force is exerted on the other of the grinding tool and the workpiece by the at least one of the grinding tool and the workpiece. Also disclosed is a grinding apparatus including: a moving device operable to move at least one of the grinding tool and the workpiece relative to the other of the grinding tool and the workpiece, at least in an infeed direction that increases a depth of cut of the grinding tool into the workpiece; and a controller which controls the moving device, such that the at least one of the grinding tool and the workpiece is pressed against the other of the grinding tool and the workpiece, with a constant force.

5 Claims, 11 Drawing Sheets

GRINDING PROCESS AND APPARATUS WITH ARRANGEMENT FOR GRINDING WITH CONSTANT GRINDING LOAD

BACKGROUND OF THE INVENTION

1. Field of the Invention

The present invention relates in general to a grinding process and a grinding apparatus for producing and finishing a surface of a workpiece with a high accuracy.

2. Discussion of Related Art

There is known, as a kind of grinding apparatus, a rotary-type vertical spindle surface grinder including: a work rotating device operable to rotate a workpiece about its axis parallel to a vertical direction; a grinding-tool rotating device operable to rotate the grinding tool about its axis parallel to the vertical direction for grinding a surface of the workpiece; a supporting device which supports the grinding-tool rotating device such that the grinding-tool rotating device is movable in a direction parallel to the axis of the grinding tool; and a grinding-tool moving device operable to move the grinding tool toward the workpiece in the direction parallel to the axis of the grinding tool. As an example of the rotary-type vertical spindle surface grinder, JP-H08-276349A (publication of unexamined Japanese Patent Application laid open in 1996) discloses a surface grinder in which a feed movement of the grinding tool or workpiece is controllable with accuracy in order of submicrons or nanomicrons.

In the rotary-type vertical spindle surface grinder disclosed in the publication of the Japanese Patent Application, a position of the grinding tool (grinding wheel) is constantly detected, and the detected position of the grinding tool is input to a controller, so that a hydraulic cylinder as the grinding-tool moving device is controlled by the controller, on the basis of the detected position of the grinding tool. That is, the disclosed grinder is equipped with a feedback control system in which the hydraulic cylinder is controlled in a closed-loop manner, whereby the workpiece can be grounded accurately by a desired amount of depth of cut of the grinding tool into the workpiece.

Like in the above-described disclosed grinder, in a conventional rotary-type vertical spindle surface grinder, it is common that the grinding tool is moved at a constant feed rate in an infeed direction (that increases the depth of cut) until the workpiece has a desired dimension or depth of cut. In such a machining method, the grinding tool is moved in the infeed direction to increase the depth of cut until the workpiece is given the desired dimension, irrespective of a grinding load which acts on the grinding tool and which is represented by a pressing force or a drive current. Therefore, a machining operation according to the conventional method can not be necessarily carried out with a sufficiently high efficiency, and can not necessarily provide a sufficiently high quality of the machined workpiece. For example, in the conventional machining operation which is carried out at a constant feed rate such that the workpiece has a desired dimension, the grinding tool could be forcedly moved at a constant feed rate in the infeed direction even in event of reduction in a grinding capacity of the tool due to clogging of its grinding surface, thereby causing glazing on the grinding surface of the tool and consequently making impossible to provide a satisfactory quality of the machined workpiece. The glazing on the grinding surface might be avoided by reducing the feed rate or reducing an amount of stock removal per a unit of time. However, such a reduction causes the workpiece to be ground with an insufficient pressing force, namely, with a low machining efficiency.

SUMMARY OF THE INVENTION

The present invention was made in the light of the background art discussed above. It is therefore a first object of the present invention to provide a process of grinding a workpiece with a sufficiently high efficiency and assuring a sufficiently high quality of the ground workpiece. It is a second object of the invention to provide a grinding apparatus capable of grinding a workpiece with a sufficiently high efficiency and assuring a sufficiently high quality of the ground workpiece. The first object may be achieved according to any one of first through seventh aspects of the invention which are described below. The second object may be achieved according to any one of eighth through twelfth aspects of the invention which are described below.

The first aspect of this invention provides a process of grinding a surface of a workpiece, by a grinding tool rotated about an axis thereof, the process comprising: a grinding step of grinding the surface of the workpiece, by pressing at least one of the grinding tool and the workpiece against the other of the grinding tool and the workpiece, such that a constant force is exerted on the other of the grinding tool and the workpiece by the at least one of the grinding tool and the workpiece.

According to the second aspect of the invention, in the process defined in the first aspect of the invention, the grinding step is implemented by moving the at least one of the grinding tool and the workpiece relative to the other of the grinding tool and the workpiece in an infeed direction that increases a depth of cut of the grinding tool into the workpiece, at a feed rate that is variable in a manner causing the at least one of the grinding tool and the workpiece to be pressed against the other of the grinding tool and the workpiece with the constant force.

According to the third aspect of the invention, in the process defined in the first or second aspect of the invention, there is further provided, in addition to the grinding step as a constant force grinding step, a constant feed-rate grinding step of grinding the surface of the workpiece, by moving the at least one of the grinding tool and the workpiece relative to the other of the grinding tool and the workpiece in an infeed direction that increases a depth of cut of the grinding tool into the workpiece, at a constant feed rate. The constant feed-rate grinding step is implemented prior to implementation of the constant force grinding step.

According to the fourth aspect of the invention, in the process defined in the third aspect of the invention, the constant feed-rate grinding step and the constant force grinding step are implemented by moving the at least one of the grinding tool and the workpiece in a direction, as the infeed direction, which is substantially parallel to the axis of the grinding tool, while rotating the workpiece about an axis thereof which is substantially parallel to the axis of the grinding tool.

According to the fifth aspect of the invention, in the process defined in the third or fourth aspect of the invention, there are provided a grinding load detecting step of detecting a grinding load acting on at least one of the grinding tool and the workpiece during implementation of the constant feed-rate grinding step; and a switching step of switching the constant feed-rate grinding step to the constant force grinding step, on the basis of the grinding load that is detected in the grinding load detecting step.

According to the sixth aspect of the invention, in the process defined in the second aspect of the invention, there are provided a feed-rate detecting step of detecting the feed rate during implementation of the grinding step; and a determining step of determining whether the grinding step should be terminated, on the basis of the feed rate detected in the feed-rate detecting step.

According to the seventh aspect of the invention, in the process defined in the fifth aspect of the invention, there are provided a feed-rate detecting step of detecting the feed rate during implementation of the constant force grinding step; and a determining step of determining whether the constant force grinding step should be terminated, on the basis of the feed rate detected in the feed-rate detecting step.

The eighth aspect of this invention provides a grinding apparatus for performing a grinding operation in which a workpiece is ground at a surface thereof by a grinding tool rotated about an axis thereof, the grinding apparatus comprising: a grinding-tool rotating device operable to rotate the grinding tool about the axis thereof, a moving device operable to move at least one of the grinding tool and the workpiece relative to the other of the grinding tool and the workpiece, at least in an infeed direction that increases a depth of cut of the grinding tool into the workpiece; and a controller which controls the moving device, such that the at least one of the grinding tool and the workpiece is pressed against the other of the grinding tool and the workpiece, with a constant force at least in a non-initial stage of the grinding operation.

According to the ninth aspect of the invention, in the grinding apparatus defined in the eighth aspect of the invention, there is provided a work rotating device operable to rotate the workpiece about an axis thereof which is substantially parallel to the axis of the grinding tool, wherein the controller controls the moving device, such that the at least one of the grinding tool and the workpiece is moved in a direction, as the infeed direction, which is substantially parallel to the axis of the grinding tool, for grinding the surface of the workpiece in the grinding operation.

According to the tenth aspect of the invention, in the grinding apparatus defined in the eighth or ninth aspect of the invention, the moving device is switchable between a constant feed-rate grinding mode and a constant force grinding mode, wherein the at least one of the grinding tool and the workpiece is moved by the moving device in the infeed direction at a constant feed rate, when the moving device is placed in the constant feed-rate grinding mode, wherein the at least one of the grinding tool and the workpiece is moved by the moving device in the infeed direction at a variable feed rate as the feed rate that causes the grinding tool to be pressed against the workpiece with a constant pressing force, when the moving device is placed in the constant force grinding mode, and wherein the moving device is placed in the constant feed-rate grinding mode in a non-final stage of the grinding operation, and is placed in the constant force grinding mode in the non-initial stage following the non-final stage.

According to the eleventh aspect of the invention, in the grinding apparatus defined in the tenth aspect of the invention, there is provided a grinding load detector operable to detect the grinding load acting on at least one of the grinding tool and the workpiece, wherein the controller includes a switching portion operable to place the moving device in the constant force grinding mode, on the basis of the grinding load detected by the grinding load detector while the moving device is placed in the constant feed-rate grinding mode.

According to the twelfth aspect of the invention, in the grinding apparatus defined in the eleventh aspect of the invention, there is provided a moving device is placed in the constant force grinding mode, wherein the controller includes a determining portion operable to determine whether the grinding operation should be terminated, on the basis of the variable feed rate detected by the feed rate detector.

In the grinding process of each of the first through seventh aspects of the invention, the grinding step or constant force grinding step is implemented such that the pressing force exerted on the grinding tool or the workpiece is substantially constant. This arrangement makes it possible to move the above-described at least one of the grinding tool and the workpiece at a feed rate that is suitable for assuring the sufficiently high quality of the ground workpiece. Further, since the feed rate is neither unnecessarily nor excessively reduced, the grinding operation can be made with a higher efficiency, than an arrangement in which the grinding operation is performed at a feed rate that is always reduced irrespective of an amount of the constant force. It is noted that the principle of the invention is equally applicable to various kinds of grinding operations such as a cylindrical grinding operation, an internal grinding operation, a centerless grinding operation, and a surface grinding operation with a vertical or horizontal spindle and a reciprocating or rotary table.

In the grinding process of each of the third through fifth and seventh aspects of the invention, the constant feed-rate grinding step is implemented in addition to the constant force grinding step that is implemented after the constant feed-rate grinding step. In this grinding process, the constant feed-rate grinding step can be implemented with the grinding efficiency being given more importance than the quality of the ground workpiece, and the constant force grinding step following the constant feed-rate grinding step can be implemented with the quality of the ground workpiece being given more importance than the grinding efficiency. Thus, a grinding operation according to this grinding process can be carried out with a sufficiently high efficiency, and can provide a sufficiently high quality of the ground workpiece.

In the grinding process of each of the fifth and seventh aspects of the invention, the constant feed-rate grinding step is switched to the constant force grinding step, based on the detected grinding load, whereby the constant force grinding step can be started at a suitable point of time.

In the grinding process of each of the sixth and seventh aspects of the invention, it is determined whether the grinding step or constant force grinding step should be terminated or not, on the basis of the actual feed rate, whereby the grinding step can be terminated at a suitable point of time.

In the grinding apparatus of each of the eighth through twelfth aspects of the invention, the controller controls the moving device such that the pressing force exerted on the grinding tool or the workpiece is substantially constant at least in the non-initial stage of the grinding operation. This arrangement makes it possible to move the above-described at least one of the grinding tool and the workpiece at a feed rate that is suitable for assuring the sufficiently high quality of the ground workpiece. Further, since the feed rate is neither unnecessarily nor excessively reduced, the grinding operation can be made with a higher efficiency, than an arrangement in which the grinding operation is performed at a feed rate that is always reduced irrespective of an amount of the constant force. It is noted that the grinding apparatus may be provided by any one of various kinds of grinding apparatuses such as a cylindrical grinder, a centerless grinder, an internal grinder, and a reciprocation- or rotary-type vertical or horizontal spindle surface grinder.

In the grinding apparatus of each of the tenth through twelfth aspects of the invention, the moving device is placed in the constant feed-rate grinding mode in the non-final stage such as an initial stage of the grinding operation, and is placed in the constant force grinding mode in the non-initial stage such as a final stage of the grinding operation. In the constant feed-rate grinding mode, the above-described at least one of the grinding wheel and the workpiece is moved at the constant feed rate, whose amount can be determined with the grinding efficiency being given more importance than the quality of the ground workpiece. In the constant force grinding mode, the above-described at least one of the grinding wheel and the workpiece is moved at the variable feed rate that causes the grinding tool to be pressed against the workpiece with the constant pressing force, whose amount can be determined with the quality of the ground workpiece being given more importance than the grinding efficiency. Thus, this grinding apparatus enables the operation to be carried out with a sufficiently high efficiency, and to provide a sufficiently high quality of the ground workpiece.

In the grinding apparatus of the eleventh aspect of the invention, the moving device is switched from the constant feed-rate grinding mode to the constant force grinding mode, based on the detected grinding load, whereby the constant force grinding mode can be started at a suitable point of time.

In the grinding apparatus of the twelfth aspect of the invention, it is determined whether the grinding operation should be terminated or not, on the basis of the actual feed rate, whereby the grinding operation can be terminated at a suitable point of time.

In the grinding process and apparatus of the fourth and ninth aspects of the invention, the rotation axis of the workpiece and the rotation axis of the grinding tool are substantially parallel to each other. The term "substantially parallel" can be interpreted to encompass an arrangement in which the rotation axis of the workpiece and the rotation axis of the grinding tool are inclined with respect to each other by a small angle.

In the grinding process of each of the third through fifth and seventh aspects of the invention, the constant feed-rate grinding step may includes a plurality of constant feed-rate grinding steps, for example, such that the constant feed rates in the respective constant feed-rate grinding steps are different from each other. Similarly, in the grinding apparatus of each of the tenth through twelfth aspects of the invention, the constant feed-rate grinding mode may include a plurality of constant feed-rate grinding modes, for example, such that the constant feed rates in the respective constant feed-rate grinding modes are different from each other. In the case with the plurality of constant feed-rate grinding steps or modes, it is preferable that the constant feed rate in each of the plurality of constant feed-rate grinding steps or modes is made lower than the constant feed rate in the other of the plurality of constant feed-rate grinding steps or modes which precedes the each constant feed-rate grinding step or mode.

The grinding load, which is detected in the grinding load detecting step or by the grinding load detector, corresponds to the pressing force exerted on the above-described other of the grinding tool and the workpiece by the above-described at least one of the grinding tool and the workpiece. The grinding load is represented, for example, by an electric power or torque required to drive the grinding-tool rotating device or the work rotating device operable to rotate the grinding tool or the workpiece which is pressed against the workpiece or the grinding tool.

In the above-described switching step or portion, the constant feed-rate grinding step or mode is switched to the constant force grinding step or mode, on the basis of the detected grinding load. Described more specifically, the constant feed-rate grinding mode may be switched to the constant force grinding mode, when a value relating to the grinding load reaches a predetermined threshold value. The value relating to the grinding load does not necessarily have to be an absolute value of the grinding load, but may be a rate of change in the value of the grinding load, such as a difference between the current value of the grinding load and a value of the grinding load at a point of initiation of the constant feed-rate grinding mode, and an amount of change in the value of the grinding load during a predetermined length of time. Further, the value relating to the grinding load can be considered to encompass a length of time that has passed after the initiation of the constant feed-rate grinding mode, since the grinding load tends to be increased with increase in the length of elapsed time.

In the above-described determining step or portion, it is determined whether the grinding step or operation should be terminated, on the basis of the detected feed rate. The determination may be made, when a value relating to the feed rate reaches a predetermined threshold value. The value relating to the feed rate does not necessarily have to be an absolute value of the feed rate, but may be a rate of change in the value of the feed rate, such as a difference between the current value of the feed rate and a value of the feed rate at a point of initiation of the constant force grinding mode, and an amount of change in the value of the feed rate during a predetermined length of time.

BRIEF DESCRIPTION OF THE DRAWINGS

The above and other objects, features, advantages and technical and industrial significance of this invention will be better understood by reading the following detailed description of presently preferred embodiment of the invention, when considered in connection with the accompanying drawings, in which.

DETAILED DESCRIPTION OF THE PREFERRED EMBODIMENT

Figure 1:
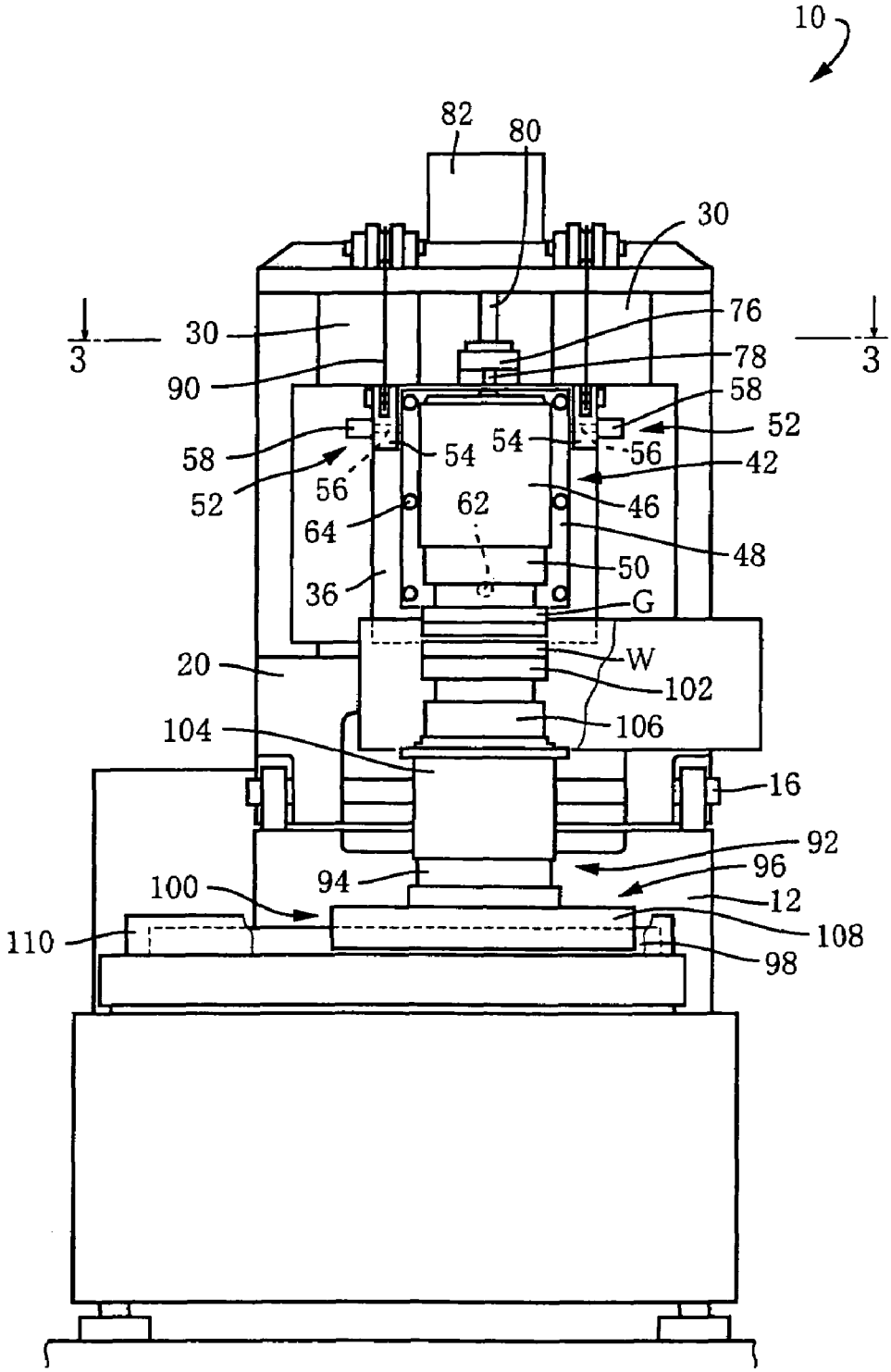
FIG. 1 is a front view of a grinding apparatus in the form of a rotary-type vertical spindle surface grinder that is constructed according to an embodiment of the invention.

There will be described in detail an embodiment of the present invention, with reference to the drawings. It is noted that elements which will be described are not necessarily accurately illustrated in the drawings, particularly in their relative dimensions.

Figure 2:
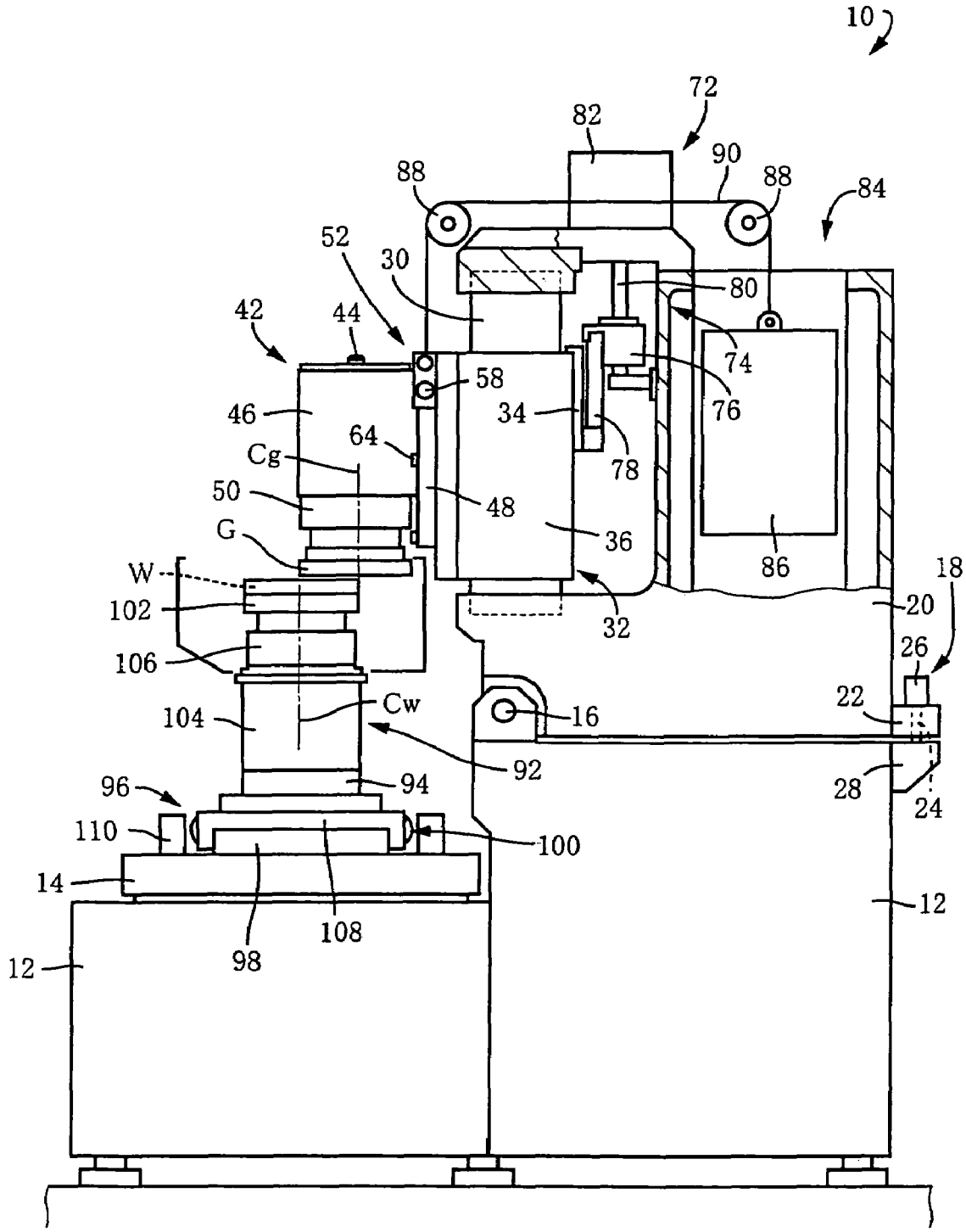
FIG. 2 is a side view of the rotary-type vertical spindle surface grinder of FIG. 1.

FIGS. 1 and 2 are front and side views of a grinding apparatus in the form of a rotary-type vertical spindle surface grinder 10 that is constructed according to the embodiment of the invention. As shown in FIGS. 1 and 2, the surface grinder 10 includes a lower frame 12 and an upper frame 20. A work table 14 is disposed on a front portion of an upper surface of the lower frame 12. The upper frame 20 is disposed on a rear portion of the upper surface of the lower frame 12, so as to be pivotable by a first tilting device 18 about a horizontally extending pin 16, such that an angle of tilt of the upper frame 20 with respect to the lower frame 12 is finely adjustable. The first tilting device 18 includes a supporting portion 22 that protrudes horizontally from a lower end portion of the upper frame 20, an externally threaded member 24 that is introduced in an internally threaded through-hole of the supporting portion 22, and a rotating device 26 operable to rotate the externally threaded member 24 about its axis. The first tilting device 18 further includes a receiving portion 28 that protrudes horizontally from an upper end portion of the lower frame 12. The externally threaded member 24, which is screwed into the internally threaded through-hole of the supporting portion 22 and extends in the vertical direction, is held in contact at its distal end with the receiving portion 28. It is noted that a non-threaded through-hole rather than the internally threaded through-hole may be formed in the supporting portion 22, and an internally threaded hole may be formed in the receiving portion 28. In this modified case, the externally threaded member 24 is arranged to pass through the non-threaded through-hole of the supporting portion 22 and to be screwed into the internally threaded hole of the receiving portion 28.

The rotating device 26 is attached to the supporting portion 22 of the upper frame 20, and is constituted by an inverter motor, a stepping motor, a servo motor or other motor whose rotation angle is accurately controllable. The upper frame 20 can be tilted or pivoted about a pivot axis (pin 16) perpendicular to a drawing sheet of FIG. 2, by causing the rotating device 26 to rotate the externally threaded member 24 about its axis. That is, the upper frame 20 can be inclined with respect to the lower frame 12, by an amount corresponding to an angle by which the externally threaded member 24 is screwed into the internally threaded through-hole of the supporting portion 22. It is noted that FIGS. 1 and 2 show a state in which the upper frame 20 is not inclined with respect to the lower frame 12. In the present embodiment, the first tilting device 18, the pin 16 and the lower frame 12 cooperate to constitute a second pivot device.

Figure 3:
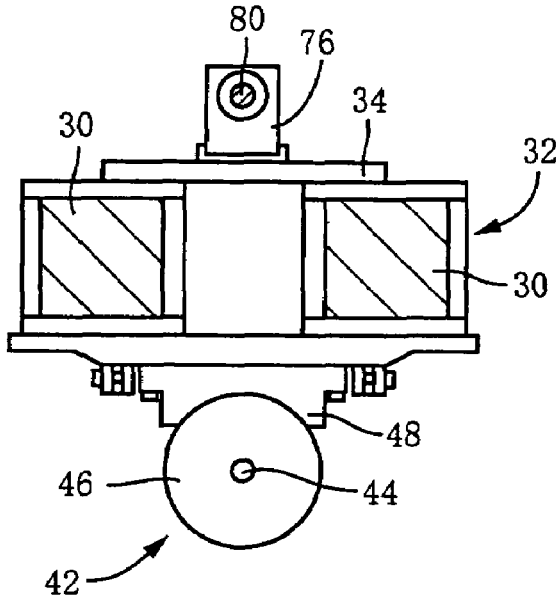
FIG. 3 is a plan view in cross-section taken along line 3-3 of FIG. 1 and showing columns of the surface grinder of FIG. 1.

The upper frame 20 is provided with a pair of vertically-extending columns 30 serving as a vertical linear guide, and a pair of static air bearing devices 32 each of which is mounted on a corresponding one of the columns 30 so as to be guided in the vertical direction. The pair of static air bearing devices 32 are connected to each other through a connecting plate 34. As shown in FIG. 3, each of the columns 30 has a substantially rectangular shape in its cross section.

Figure 4:
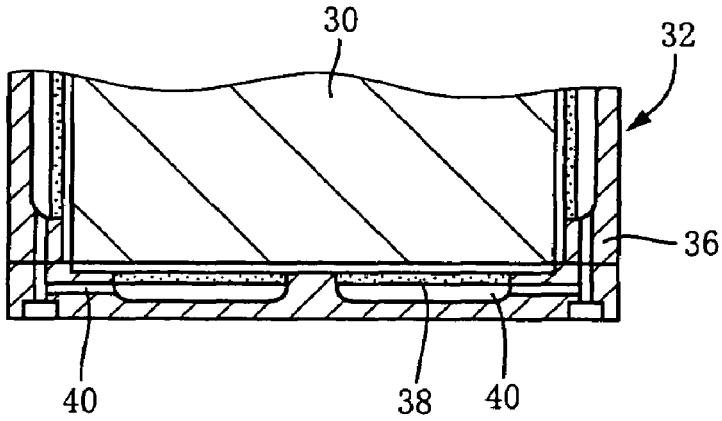
FIG. 4 is a cross sectional view showing a part of a static air bearing device for supporting a grinding-wheel rotating device that is vertically movable.

As shown in FIG. 4, each of the static air bearing devices 32 includes: a housing 36 surrounding four guide surfaces of the corresponding column 30; and porous members 38 disposed within the housing 36 and opposed to the guide surfaces of the column 30, such that a small clearance is formed between each of the porous members 38 and a corresponding one of guide surfaces. Each of the porous members 38 defines an air supply passage 40 that is located on one of opposite sides of the porous member 38 that is remote from the guide surface, so that a highly pressurized gas (e.g. pressurized air) is supplied to the above-describe small clearance through the air supply passage 40 and pores of the porous member 38. This arrangement enables the housing 36 to be supported or bound by the column 30 through the highly pressurized gas or air that is interposed between therebetween, although the housing 36 and the column 30 are not held in direct contact with each other.

Figure 5:
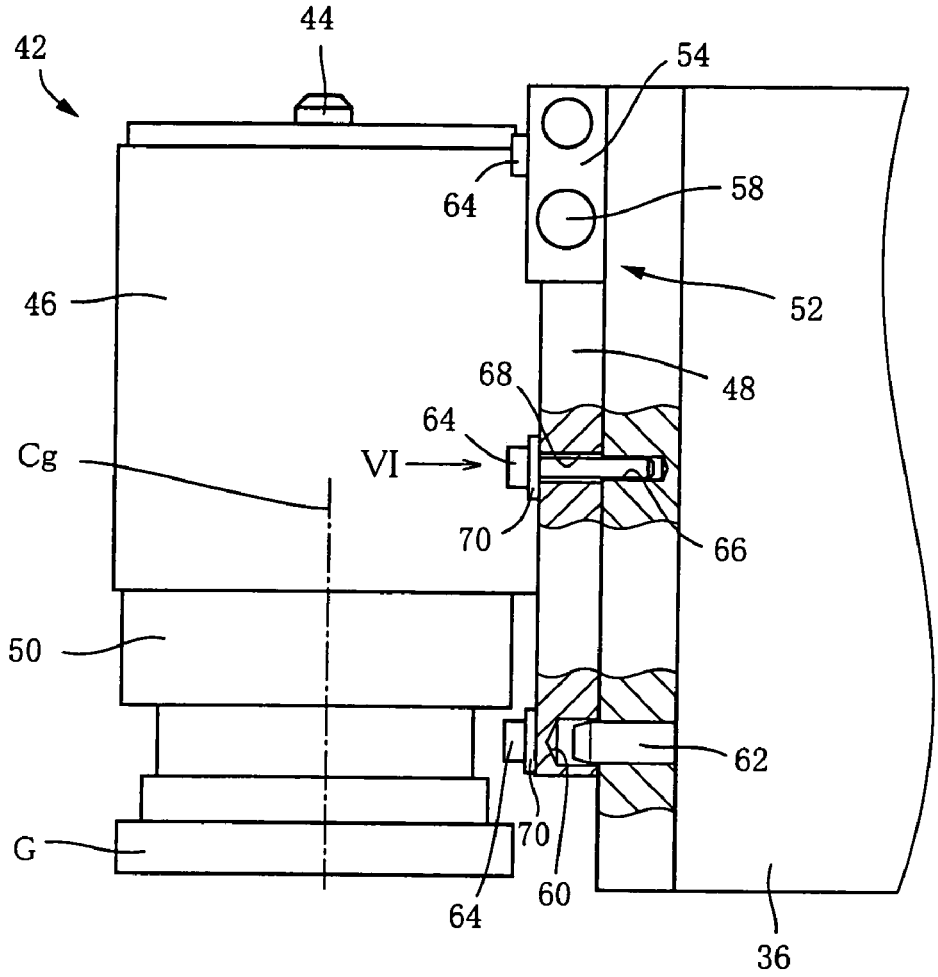
FIG. 5 is an enlarged view of a part of FIG. 2, showing a second tilting device of the surface grinder.

To the static air bearing devices 32, there is attached a grinding-wheel rotating device 42 that is operable to rotate a grinding wheel G as a grinding tool about its axis, for grinding a surface (upper surface) of a plate-like shaped workpiece W such as a glass plate and a semiconductor wafer. Thus, the columns 30 and the static air bearing devices 32 (guided by the columns 30) cooperate to serve as a supporting device for supporting the grinding-wheel rotating device 42 such that the grinding-wheel rotating device 42 is movable in the vertical direction. The axis of the grinding wheel G extends substantially in the vertical direction, although the direction of the axis is variable as needed. The grinding wheel G is of a cup type, and is brought into contact at its axial end face with the surface of the workpiece W that is to be ground. As shown in FIG. 5, the grinding-wheel rotating device 42 includes: a rotary shaft (wheel spindle) 44 having an axially lower end portion at which the grinding wheel G is attached; a motor 46 operable to rotate the rotary shaft 44; a fixture plate 48 to which the motor 46 is fixed; and a static air bearing device 50 supporting the rotary shaft 44 through a static air, such that the rotary shaft 44 is rotatable. The static air bearing device 50 is arranged to support the rotary shaft 44 in a non-contact manner, i.e., through a highly pressurized gas or air supplied from porous members that are opposed to an outer circumferential surface of the rotary shaft 44.

A pair of second tilting devices 52, 52 are provided in an upper end portion of the fixture plate 48, and are fixed to the static air bearing devices 32. Each of the second tilting devices 52, 52 includes: a supporting member 54 fixed to a surface of the housing 36; an externally threaded member 56 screwed into an internally threaded hole formed in the supporting member 54; and a rotating device 58 operable to rotate the externally threaded member 56 about its axis extending in the horizontal direction. The externally threaded members 56, 56 of the respective second tilting devices 52, 52 are held in contact at their distal ends with upper end portions of respective opposite end surfaces of the fixture plate 48. Each of the rotating devices 58, 58 of the respective second tilting devices 52, 52 is attached to the corresponding supporting member 54, and is constituted by an inverter motor, a stepping motor, a servo motor or other motor whose rotation angle is accurately controllable. The rotating devices 58, 58 are controlled by a controller (not shown), so as to be rotatable in respective directions opposite to each other by respective amounts equal to each other. In the present embodiment, the second tilting devices 52, 52, the upper frame 20 and the static air bearing devices 32 cooperate to constitute a first pivot device. It is noted that a non-threaded through-hole rather than the internally threaded through-hole may be formed in each of the supporting members 54, and an internally threaded hole may be formed in each of the opposite end surfaces of the fixture plate 48. In this modified case, each of the externally threaded members 56, 56 is arranged to pass through the non-threaded through-hole of the corresponding supporting member 54 and to be screwed into the internally threaded hole of the corresponding end surface of the fixture plate 48.

When the externally threaded members 56, 56 are rotated about their axes by the respective rotating devices 58, 58, one of the threaded members 56, 56 is displaced toward the fixture plate 48 while the other of the threaded members 56, 56 is displaced away from the fixture plate 48, so that a pressing force with which the one of the threaded members 56, 56 is pressed against the upper end of the corresponding end surface of the fixture plate 48 is increased while a pressing force with which the other of the threaded members 56, 56 is pressed against the upper end of the corresponding end surface of the fixture plate 48 is reduced. As best shown in FIG. 5, a blind hole 60 is formed in the fixture plate 48 so as to open in its rear surface (that faces the housing 36), while a pin 62 is provided to protrude from the housing 36 so as to be received in the blind hole 60. The blind hole 60 and the pin 62 have respective axes extending in a direction perpendicular to a drawing sheet of FIG. 1, and have substantially the same diameter. The pin 62 is fitted in the blind hole 60 with a small clearance permitting a relative rotation of the blind hole 60 and the pin 62 about their axes. Thus, the fixture plate 48 can be tilted or pivoted about a pivot axis (pin 62), by causing the rotating devices 58, 58 to forward and reverse the above-described one and other of the externally threaded members 56, 56, respectively. That is, the fixture plate 48 can be inclined with respect to the vertical direction, by an amount corresponding to an angle by which each of the externally threaded members 56, 56 is screwed into the internally threaded through-hole of the corresponding supporting member 54. FIGS. 1 and 2 show a state in which the fixture plate 48 is not inclined with respect to the vertical direction. It is noted that, in the above-described modified case in which each of the externally threaded members 56, 56 is arranged to pass through the non-threaded through-hole of the corresponding supporting member 54 and to be screwed into the internally threaded hole of the corresponding end surface of the fixture plate 48, the fixture plate 48 is pivoted about the pin 62 in a direction toward one of the threaded members 56, 56 rotated in its screwing direction, away from the other of the threaded members 56, 56 rotated in its unscrewing direction.

With the fixture plate 48 being pivoted as described above, the rotary shaft 44 of the motor 46 fixed to the fixture plate 48 is pivoted together with the fixture plate 48 about the pivot axis that is perpendicular to the drawing sheet of FIG. 1, so as to be inclined with respect to the vertical direction. Further, where the upper frame 20 is pivoted by the first tilting device 18, the fixture plate 48 is pivoted together with the upper frame 20 about the pin 16, as is apparent from FIG. 2, whereby the rotary shaft 44 of the motor 46 fixed to the fixture plate 48 is pivoted together with the fixture plate 48 about the pivot axis that is perpendicular to the drawing sheet of FIG. 2. Therefore, the rotary shaft 44 of the motor 46, i.e., an axis Cg of the grinding wheel G can be pivoted about the pivot axis perpendicular to the drawing sheet of FIG. 1 and about the pivot axis perpendicular to the drawing sheet of FIG. 2. In other words, the axis Cg of the grinding wheel G can be pivoted about two pivot axes which are not parallel to the axis Cg of the grinding wheel G and which are not parallel to each other.

Figure 6:
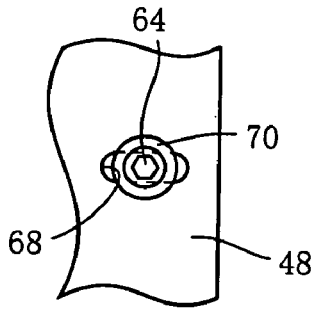
FIG. 6 is a view as seen in a direction indicated by arrow 6 of FIG. 5, showing an attachment of a fixture plate to the second tilting device.

As shown in FIGS. 1 and 2, the fixture plate 48 is fixed to the housing 36 by means of a total of six socket-head screws (externally threaded members) 64, each of which has a hexagonal recess formed in its head. Each of the screws 64 is arranged to pass through a washer 70 and a through-hole 68 formed in the fixture plate 48 and is tightly screwed into an internally threaded hole 66 formed in the housing 36. As shown in FIG. 6, the though-hole 68 is an elongated hole that is elongated in a direction corresponding to the right and left directions as seen in FIG. 1. It is noted that a small diameter of the through-hole 68 as well as a large diameter of the through-hole 68 is sufficiently larger than a diameter of a threaded portion of the screw 64, so that the screw 64 passes through the through-hole 68 with a relatively large play therebetween.

Figure 7:
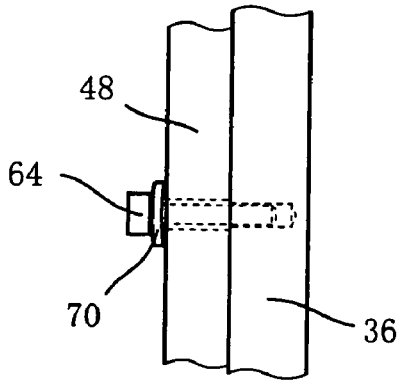
FIG. 7 is an enlarged view of a part of FIG. 5, showing an arrangement for giving a resistance to a pivot motion of the second tilting device.

The washer 70 is provided by a disk spring or the like, as best shown in FIG. 7 that illustrates a state in which the screw 64 is slightly loosened. The washer 70 is elastically deformed or flattened by tightening the screw 64. Thus, even in the illustrated state, the washer 70 biases or forces the fixture plate 48 to be pressed against the housing 36.

Figure 9:
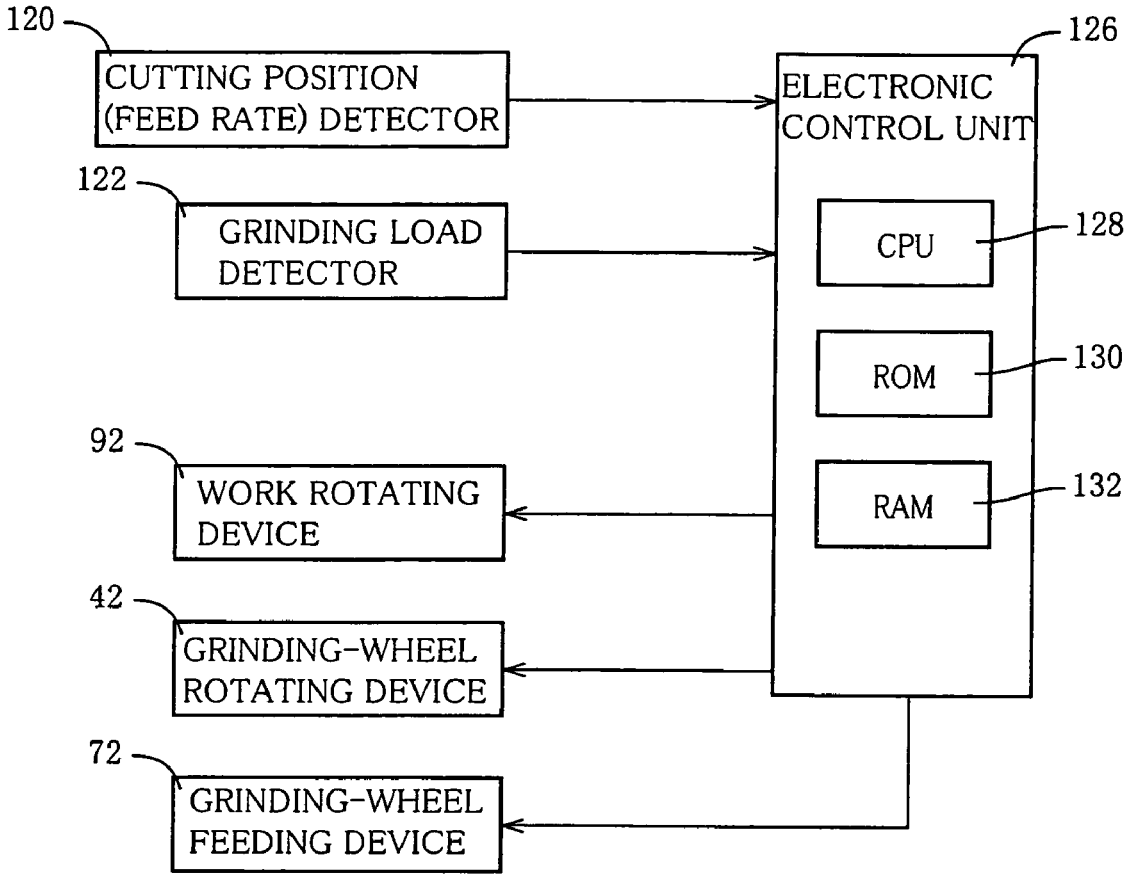
FIG. 9 is a block diagram showing a main portion of a control system that is provided in the surface grinder of FIG. 1.

As shown in FIGS. 1 and 2, the upper frame 20 is provided with a moving device in the form of a grinding-wheel feeding device 72 operable to move or feed the grinding wheel G toward the workpiece W substantially in the vertical direction (i.e., in a direction parallel to the axis Cg of the grinding wheel G, namely, in an infeed direction that increases a depth of cut of the grinding wheel G into the workpiece W) at a feed rate that is controllable by an electronic control unit (ECU) 126 (see FIG. 9). The wheel feeding device 72 includes: a feed screw device 74 which is fixedly disposed in the upper frame 20; and a piezoelectric actuator 78 which is disposed between the above-described connecting plate 34 (connecting the pair of static air bearing devices 32) and a movable nut member 76 movable by the feed screw device 74 and which is operable to move the static air bearing devices 32 in a direction parallel to the movement of the movable nut member 76. The feed screw device 74 includes a feed screw 80 provided in the upper frame 20, rotatably about its axis extending in the vertical direction; and a motor 82 provided in the upper frame 20 and connected to the feed screw 80, so that the movable nut member 76 (held in thread engagement with the feed screw 80) is movable in the vertical direction, when the feed screw 80 is rotated by the motor 82. The piezoelectric actuator 78 is constituted by a plurality of piezoelectric ceramic plates that are superposed on each other, and has a total length that is accurately variable by 200 (μm) or less in response to a drive voltage applied thereto, so as to provide an output of 6 (kN), for example.

Further, the upper frame 20 is provided with a load balancer 84 serving to alleviate uneven distribution of pressure over the guide surfaces of each of the columns 30, wherein the uneven distribution arises from a load or weight of the grinding-wheel rotating device 42 which is held by a front portion of each of the static air bearing devices 32. The load balancer 84 includes: a counterweight 86 having substantially the same weight as the grinding-wheel rotating device 42 and arranged to be movable upwardly and downwardly within the upper frame 20; and a cable 90 connecting the counterweight 86 and the grinding-wheel rotating device 42 and guided by a pair of pulleys 88, 88 so as to have a generally inverted U shape as shown in FIG. 2. The counterweight 86 facilitates the grinding-wheel rotating device 42 to be moved upwardly, and reduces the load of the grinding-wheel rotating device 42 irrespective of a height position of the rotating device 42.

Figure 8A:
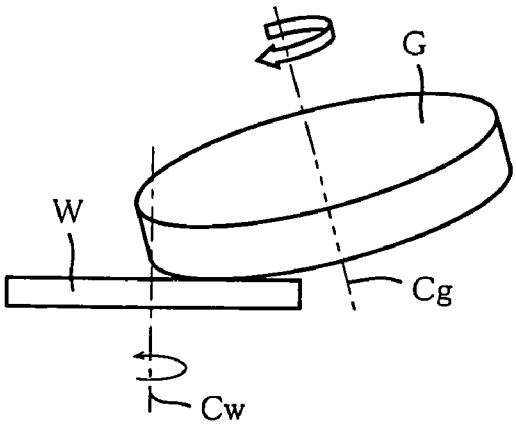
FIGS. 8A and 8B are front and plan views for showing an inclination of a grinding wheel with respect to a workpiece during a grinding operation that is performed in the surface grinder of FIG. 1.
Figure 8B:
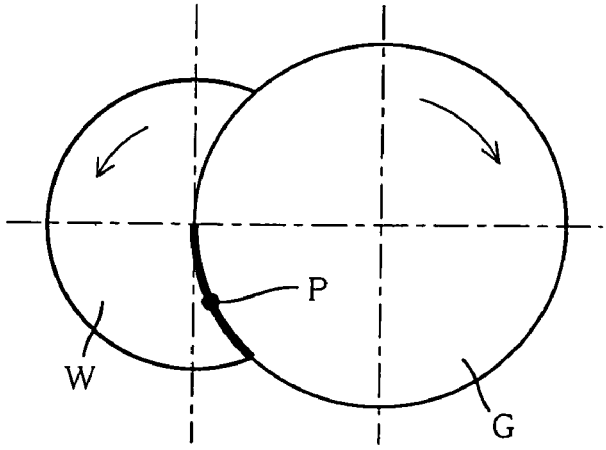

The lower frame 12 is provided with a work rotating device 92, which is operable to rotate the workpiece W about its axis Cw extending in the vertical direction so that the workpiece W is ground at its upper surface by the grinding wheel G. The work rotating device 92 is disposed on the lower frame 12, with the work table 14, a three-force-components dynamometer 94 and a supporting device 96 which are interposed therebetween. The work rotating device 92 is supported by the supporting device 96, movably in a predetermined horizontal direction. To this end, the supporting device 96 includes: a horizontally extending guide member 98; and a static air bearing device 100 which is connected to the work rotating device 92 and which is guided by the guide member 98 in the predetermined horizontal direction, in presence of a static air between the bearing device 100 and a guide surface of the guide member 98. As shown in FIG. 8B, the workpiece W fixed to the work rotating device 92 is positioned relative to the grinding wheel G, such that the workpiece W and the grinding wheel G overlap with each other by an amount corresponding to a radius of the workpiece W, as viewed in the plan view.

The work rotating device 92 includes: a rotary shaft (not shown); a motor 104 operable to rotate the rotary shaft; and a static air bearing device 106 fixed to the motor 104 and supporting the rotary shaft through a static air. The rotary shaft is fixed to a sucker plate 102 to which the workpiece W is to be detachably attached. The static air bearing device 106 is arranged to support the rotary shaft in a non-contact manner, i.e., through a highly pressurized gas or air supplied from porous members that are opposed to an outer circumferential surface of the rotary shaft. Like the above-described static air bearing devices 32, the above-described static air bearing device 100 includes: a housing 108 surrounding guide surfaces of the horizontally extending guide member 98; and porous members (not shown) disposed within the housing 98 and opposed to the guide surfaces of the guide member 98, such that a small clearance is formed between each of the porous members and a corresponding one of guide surfaces. Each of the porous members defines an air supply passage that is located on one of opposite sides of the porous member that is remote from the guide surface, so that a highly pressurized gas or air is supplied to the above-described small clearance through the air supply passage and pores of the porous member. This arrangement enables the housing 108 to be restrained from being moved in any direction other than the above-described predetermined horizontal direction (in which the housing 108 is guided by the guide member 98), owing to the highly pressurized gas or air that is interposed between the housing 108 and the guide member 98, although the housing 108 and the guide member 98 are not held in direct contact with each other. It is noted that the housing 108 is reciprocatable in the above-described predetermined horizontal direction, i.e., in the right and left directions as seen in FIG. 1, by a horizontal movement device 110 such as a linear motor, or by a manual operation.

For grinding a surface of the workpiece W such as a silicone wafer in the rotary-type vertical spindle surface grinder 10 constricted as described above, the upper frame 20 and the fixture plate 48 are pivoted about the respective pins 16, 62 by operating the first and second tilting devices 18, 52, such that the axis Cg of the grinding wheel G is inclined with respect to the vertical direction by a predetermined angle. In the present embodiment, the axis Cg is inclined by about 0.03° in counterclockwise direction as seen in FIG. 1 and is inclined by about 0.03° in counterclockwise direction as seen in FIG. 2. Thus, the grinding wheel G has a posture slightly inclined with respect to the workpiece W such that its front end portion has a height slightly smaller than its rear end portion and such that its left end portion has a height slightly smaller than its right end portion, as shown in FIG. 8A. Further, the axis Cg of the grinding wheel G is offset from the axis Cw of the workpiece W by a distance equal to the radius of the grinding wheel G, so that a periphery of the grinding wheel G passes through the axis Cw of the workpiece W, as shown in FIG. 8B which indicates a positional relationship therebetween as seen in the plan view. A lowermost point P of the lower surface (grinding surface) of the grinding wheel W lies at a position which is located between the axis Cw and periphery of the workpiece W and which is distant from the axis Cw of the workpiece W by a distance substantially equal to a half of the radius of the workpiece W. In the present embodiment, the first and second tilting devices 18, 52 are provided to permit the axis Cg of the grinding wheel G to be inclined on each of two planes intersecting each other at right angle, for establishing the above-described posture of the grinding wheel G. It is noted that a height difference between the lowermost point P and a highermost point (not shown) of the lower surface of the grinding wheel W is about 20 (μm). It is further noted that, the grinding wheel G is constituted by a cylindrical substrate and a multiplicity of abrasive chips bonded to a lower end surface of the cylindrical substrate and arranged in a circumferential direction of the cylindrical substrate, although its entirety is represented merely by a disk-shaped body in the interest of simplification of the illustration, The angle or amount of the pivot of the upper frame 20 about the pin 16 can be stabilized to correspond to the angle or amount of rotation of the externally threaded member 24 of the first tilting device 18, with substantially no disturbance influencing thereon, even during a grinding operation effected in the surface grinder 10. This is because a relatively large load (corresponding to a sum of weights of the upper frame 20 and other components directly or indirectly attached to the frame 20) acts in the clockwise direction as seen in FIG. 2, i.e., in a direction that reduces the angle or amount of the pivot of the upper frame 20. On the other hand, the angle or amount of the pivot of the fixture plate 48 (to which the grinding-wheel rotating device 42, static air bearing device 50 and grinding wheel G are attached) about the pin 62 could be easily changed by the load exerted on the grinding wheel G by the workpiece W, since a relatively small load acts in a direction that reduces the angle or amount of the pivot of the fixture plate 48. That is, the angle or amount of the pivot of the fixture plate 48 is unlikely to be stabilized to correspond to the angle or amount of rotation of each of the externally threaded members 56.

In view of the instability of the pivot amount of the fixture plate 48, the surface grinder 10 according to the present embodiment is provided with means for fixing the fixture plate 48 to the housing 36. Described specifically, after the fixture plate 48 has been tilted by the predetermined angle by the second tilting device 52, the above-described six clamp screws 64 are tightly screwed for maintaining the pivot amount of the fixture plate 48. When the fixture plate 48 is intended to be pivoted, the screws 64 are not fully tightened, as shown in FIG. 7. That is, the pivot motion is given to the fixture plate 48 in a state in which the washers 70 are elastically deformed, namely, in a semi-fixed state in which the fixture plate 48 is pressed against the housing 36 owing to a pressing force exerted on the fixture plate 48 by the elastically deformed washers 70 that intend to restore their original shapes. Thus, when the screws 64 are tightly screwed, the pressing force generated by the washers 70 serves to advantageously restrain the fixture plate 48 from being pivoted about the pin 62 due to tightening torque applied to the screws 64. Owing to this arrangement, the pivot amount of the fixture plate 48, which has been established by the rotating devices 58 capable of pivoting the fixture plate 48 with a high accuracy, does not suffer undesirable variation. It is therefore possible to accurately establish a desired angle of inclination of the axis Cg of the grinding wheel G, irrespective of the direction of the inclination. In the present embodiment, the screws 64 serving as fasteners and the washers 70 serving as interposed members cooperate to constitute a resistance applying device.

Since the fixture plate 48 is pivoted by the second tilting device 52 with the pressing force being exerted on the fixture plate 48 by the washers 70, as described above, the rotating devices 58 is required to have a driving capacity sufficiently larger than a resistance which is based on the pressing force and which acts against the pivot motion of the fixture plate 48 relative to the housing 36. In the present embodiment, the driving capacity of the rotating devices 58 is about twenty times as large as the resistance against the pivot motion in the above-described semi-fixed state, so that the fixture plate 48 is pivotable in spite of presence of the pressing force exerted on the fixture plate 48 by the washers 70.

Each of the elongated holes 68 formed through the fixture plate 48 is configured to allow the fixture plate 48 to be pivoted by a predetermined angle. Since there is a certain amount of play between each of the screws 64 and the corresponding elongated hole 68, the pivot motion of the fixture plate 48 is not impeded even where the screws 64 are tightened to establish the above-described semi-fixed state. The fixture plate 48 can be pivoted by an angle not larger than an angle corresponding to a horizontal length (i.e., large diameter) of each elongated hole 68.

After the axis Cg of the grinding wheel G has been inclined as described above, the grinding wheel G and the workpiece W (that is fixed to the sucker plate 102) are rotated about their respective axes Cg, Cw in predetermined directions, while the grinding wheel G is lowered by the feed screw device 74 to be brought into proximity with the workpiece W. FIG. 8A shows the positional relationship therebetween in this state in which the grind wheel G is in proximity with the workpiece W while maintaining its posture inclined with respect to the workpiece W (namely, with the axis Cg being inclined with respect to the axis Cw). Then, the grinding wheel G is caused to cut into the workpiece W by activation of the piezoelectric actuator 78, whereby the workpiece W is subjected at its upper surface to a grinding operation. In the grinding operation, the grinding wheel G is held in contact, only at its portion whose range is represented by thick line in FIG. 8B, with the workpiece W, due to its inclined posture and the positioning of the above-described lowermost point P at the position that is distant from the axis Cw of the workpiece W by the distance substantially equal to the half of the radius of the workpiece W. That is, the grinding wheel G is held in contact with only a portion of the workpiece W, which portion extends by a distance corresponding to the radius of the workpiece W. However, the workpiece W can be ground at the entire surface by the entirety of the grinding surface of the grinding wheel G, since the workpiece W and the grinding wheel G are rotated about their respective axes Cg, Cw.

The grinding wheel G is fed in the infeed direction until the workpiece W is given a predetermined thickness value. After that, the work table 14 is pivoted about the axis Cw of the workpiece W in the counterclockwise direction by a predetermined angle, while the grinding wheel G and the workpiece W are continuously rotated, for thereby inclining the direction in which the workpiece W is movable along the horizontally extending guide member 98. Then, the horizontal movement device 110 causes the housing 108 to be reciprocated along the guide member 98 in front and rear directions, so that the above-described lowermost point P is moved between the axis Cw and the periphery of the workpiece W, in the horizontal direction that is perpendicular to the axis Cw of the workpiece W. As a result of this reciprocation of the housing 108, the workpiece W is ground by the lowermost point P at its portions adjacent to the axis Cw and the periphery, which have been ground by a relatively small depth of cut while the relative position of the workpiece W and the grinding wheel G in the horizontal direction has been fixed. Thus, the workpiece W is ground at an entirety of its surface by the lowermost point P of the grinding surface of the grinding wheel G, whereby the surface of the workpiece W is completely flattened. After the housing 108 has been reciprocated a suitable number of times, for example, one time, the grinding wheel G is moved upwardly to be separated from the workpiece W while the work table 14 is returned to its home position. The workpiece W is then removed from the sucker plate 102, whereby the grinding operation to the single workpiece W is completed. The surface of the workpiece W, which has been thus ground, is given a high flatness of about 1 (μm).

FIG. 9 is a block diagram showing a control system that is provided in the surface grinder 10. A cutting position detector 120 is provided to detect a cutting or grinding position in which the workpiece W is being currently ground by the grinding wheel G, namely, detect a current position of the grinding wheel G relative to the workpiece W in the infeed direction, i.e., in a direction substantially parallel to the axis Cg of the grinding wheel G. The cutting position detector 120 is provided by, for example, an optical linear scale arranged to detect a current position of the motor 46 relative to the fixture plate 48 in the direction substantially parallel to the axis Cg of the grinding wheel G. A grinding load detector 122 is provided to a machining or grinding load exerted on the grinding wheel G by the workpiece W, and is provided by, for example, a current detector coil arranged to detect an output torque of the motor 46 or a drive current supplied to the motor 46 (that is changed in close relation with the output torque). An output signal representative of the position of the grinding wheel G relative to the workpiece W detected by the cutting position detector 120 and an output signal representative of the grinding load exerted on the grinding wheel G by the workpiece W detected by the grinding load detector 122 are supplied to an electronic control unit (ECU) 126.

The ECU 126 includes a so-called microcomputer incorporating a CPU 128, a ROM 130, a RAM 132 and an input/output interface (not shown), and is arranged to process the signals according to programs stored in the ROM 130 while utilizing a temporary data storage function of the RAM 132, to control the grinding operation effected in the surface grinder 10, by controlling the grinding-wheel rotating device 42, wheel feeding device 72 and work rotating device 92.

Figure 10:
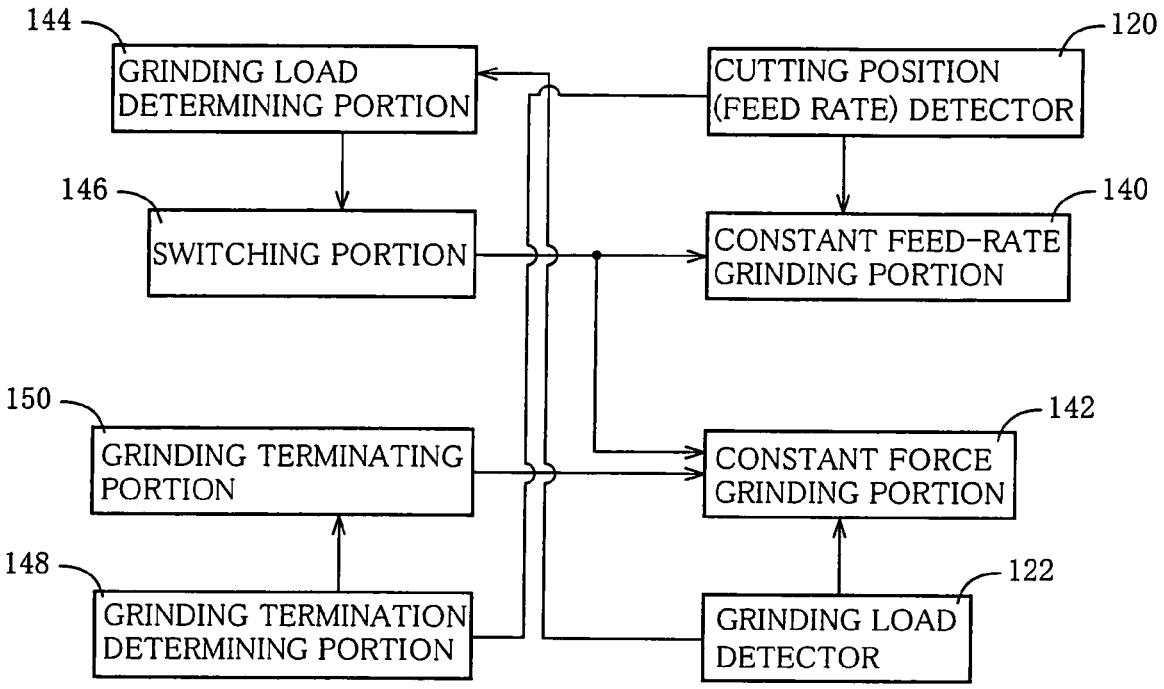
FIG. 10 is a block diagram showing various functional means incorporated in ECU of FIG. 9.

FIG. 10 is a block diagram showing various functional means incorporated in the ECU 126 of FIG. 9, for controlling the grinding operation. The ECU 126 includes a constant feed-rate grinding portion 140, a constant force grinding portion 142, a grinding load determining portion 144, a switching portion 146, a grinding termination determining portion 148 and a grinding terminating portion 150. The constant feed-rate grinding portion 140 is operable to cause the grinding-wheel feeding device 72 as the moving device to be placed in its constant feed-rate grinding mode in which the grinding wheel G is moved by the grinding-wheel feeding device 72 in the infeed direction at a constant feed rate of, for example, 5 μm/min, so as to grind the workpiece W. This constant feed control may be made in an open-loop manner, in which the feeding device 72 is controlled by the ECU 126 to move the grinding wheel G at the desired feed rate of 5 μm/min without the ECU 126 checking whether the grinding wheel G is actually being moved at the desired feed rate of 5 μm/min, or alternatively, may be made in a closed-loop manner with provision of a feedback unit, in which the feeding device 72 is controlled by the ECU 126 such that the actual feed rate detected by the grinding position detector 120 (serving also as a feed rate detector) is equal to the desired feed rate of 5 μm/min. In the closed-loop control, where the actual feed rate is different from the desired feed rate, the feeding device 72 is controlled by the ECU 126 to compensate the difference. The constant force grinding portion 142 is operable to cause the grinding-wheel feeding device 72 to be placed in its constant force grinding mode in which the grinding wheel G is moved by the grinding-wheel feeding device 72 in the infeed direction such that the grinding wheel G is pressed against the workpiece W with a constant force of, for example, 100 g/cm$^2$, namely, such that an amount of the drive current supplied to the motor 46 of the grinding-wheel rotating device 42 corresponds to the pressing force of 100 g/cm$^2$. This constant force control may be made in an open-loop manner, in which in which the feeding device 72 is controlled by the ECU 126 to move the grinding wheel G at a feed rate that causes the grinding wheel G to be pressed against the workpiece W with the desired force of 100 g/cm$^2$ without the ECU 126 checking whether the grinding wheel G is actually being pressed against the workpiece W with the desired force of 100 g/cm$^2$, or alternatively, may be made in a closed-loop manner with provision of the feedback unit, in which the feeding device 72 is controlled by the ECU 126 such that the actual pressing force detected by the grinding load detector 122 is equal to the desired force of 100 g/cm$^2$.

Figure 11:
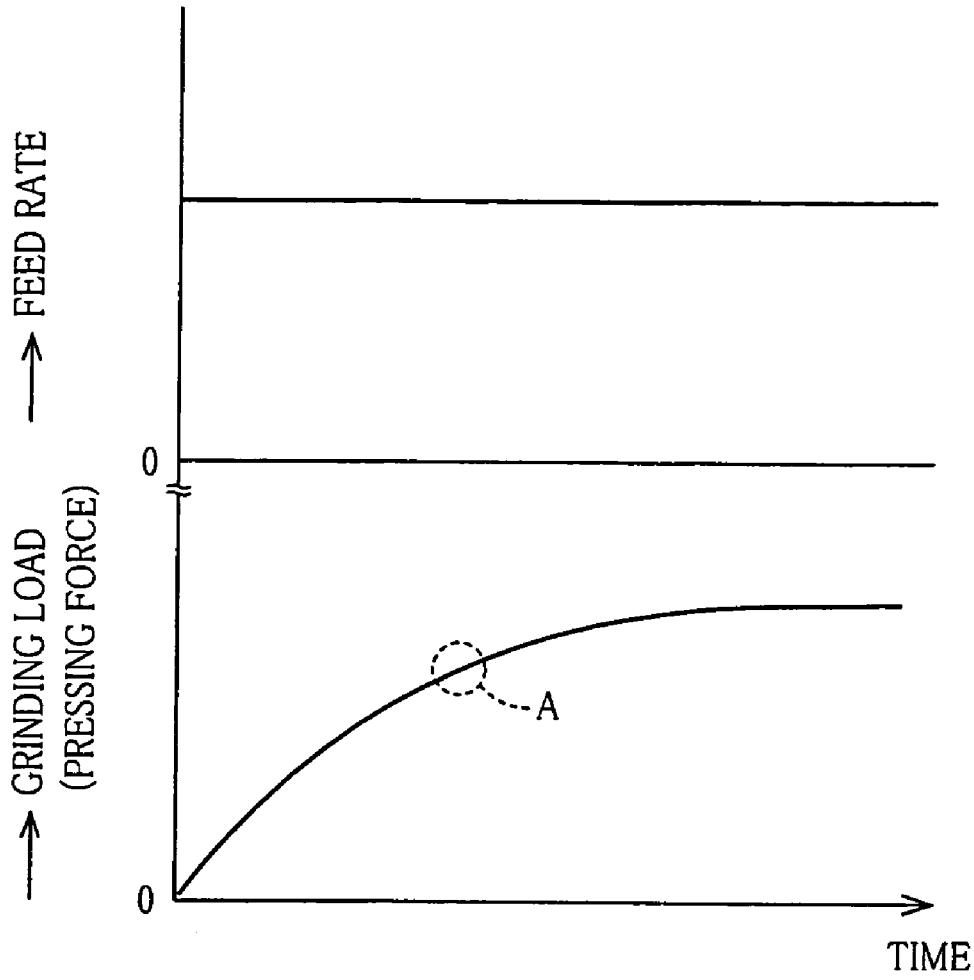
FIG. 11 is a graph showing a relationship between a feed rate of the grinding wheel and a grinding load acting on the grinding wheel, in a constant feed-rate grinding step of a grinding operation that is performed by the surface grinder of FIG. 1.
Figure 12:
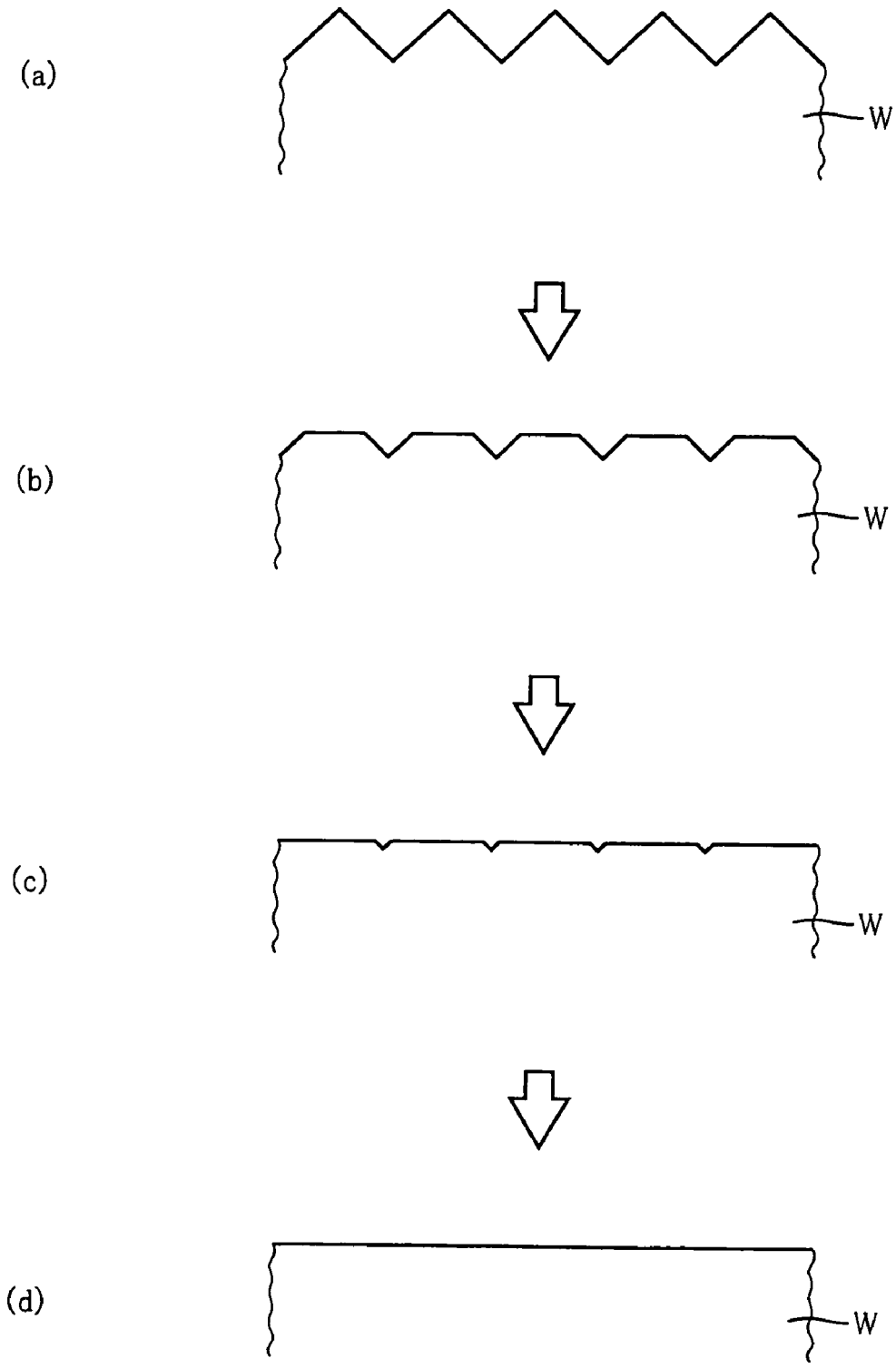
FIG. 12 is a set of views illustrating change in pits and projections on a surface of a workpiece during the grinding operation.

FIG. 11 is a graph showing characteristics exhibited in the above-described constant feed-rate grinding mode. As is apparent from the graph of FIG. 11, in the constant feed-rate grinding mode, the grinding load (i.e., the pressing force with which the grinding wheel G is pressed against the workpiece W) is substantially linearly increased until a certain length of time has passed. After that, a rate of the increase of the grinding load is reduced and is eventually zeroed. That is, as a result of a gradual increase of contact area (ground area) at which the grinding wheel G is in contact with the workpiece W, a grinding resistance is gradually increased while a cutting sharpness (cutting efficiency) of the grinding wheel G is reduced. FIG. 12 is a set of views illustrating change in a surface of a workpiece in the grinding operation in which the grinding-wheel feeding device 72 is first placed in its constant feed-rate grinding mode and then placed in its constant force grinding mode. In FIG. 12, the views (a), (b) show the change in the workpiece surface in stage of the constant feed-rate grinding mode.

Figure 13:
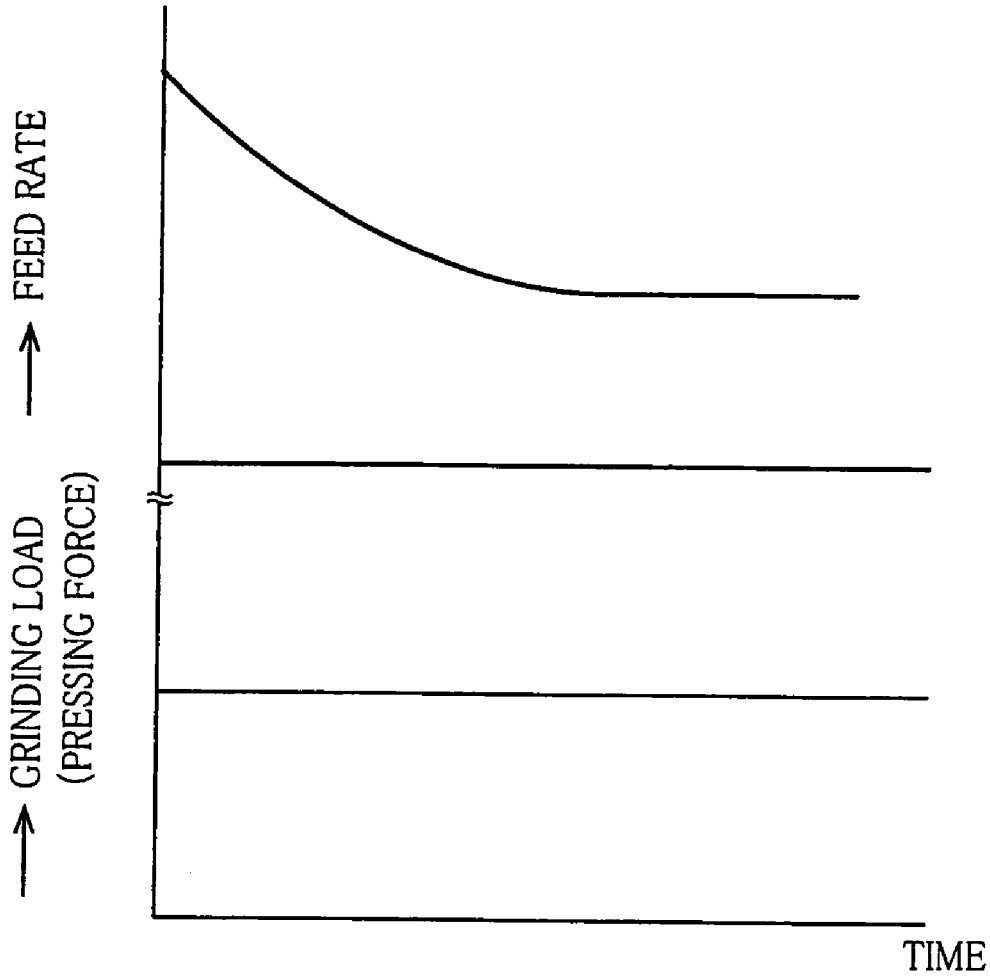
FIG. 13 is a graph showing a relationship between the feed rate of the grinding wheel and the grinding load acting on the grinding wheel, in a constant force grinding step of the grinding operation that is performed by the surface grinder of FIG. 1.

FIG. 13 is a graph showing characteristics exhibited in the constant force grinding mode in which the feed rate (grinding rate) of the grinding wheel G relative to the workpiece W is substantially linearly reduced until a certain length of time has passed since initiation of the constant force grinding mode. After that, a rate of the reduction of the feed rate is reduced and is eventually zeroed. That is, as a result of the gradual increase of contact area (ground area) at which the grinding wheel G is in contact with the workpiece W, with the grinding load being held constant, the feed rate is gradually reduced and eventually held constant. In FIG. 12, the views (b)-(d) show the change in the workpiece surface in stage of the constant force grinding mode.

The grinding load determining portion 144 is operable to determine, in stage of the constant feed-rate grinding mode, whether a machining pressure P (i.e., pressing force or grinding load) represented by the drive current which is supplied to the grinding-wheel rotating device 42 and which is detected by the grinding load detector 122 has exceeded a predetermined threshold value P1, or whether an amount ΔP of change of the machining pressure P per a unit of time Δt, i.e., a rate (ΔP/Δt) has exceeded a predetermined threshold value ΔP1. The switching portion 146 is operable, when it is determined by the grinding load determining portion 144 that the machining pressure P has exceeded the predetermined threshold value P1, to automatically switch the feeding device 72 from the constant feed-rate grinding mode to the constant force grinding mode. The above-described predetermined threshold value P1 or ΔP1 is a value at a point which is indicated by A in FIG. 11 and which is shortly before the rate of the increase of the machining pressure P is zeroed or shortly before the grinding surface is grazed due to its clogging. That is, the threshold value P1 or ΔP1 is predetermined to detect such a critical point.

The grinding termination determining portion 148 is operable to determine, in stage of the constant force grinding mode, whether the constant force grinding operation (performed by the constant force grinding portion 142) should be terminated, by seeing whether the actual feed rate V of the grinding wheel G detected by the grinding position detector 120 has been reduced to be smaller than a predetermined threshold value V1 that is a value in vicinity of a point at which the rate of the reduction of the feed rate V is zeroed, or by seeing whether an amount ΔV of change of the feed rate V per a unit of time Δt, i.e., a rate (ΔV/Δt) has been reduced to be smaller than a predetermined threshold value ΔV1. The grinding terminating portion 150 is operable, upon determination by the grinding termination determining portion 148 that the constant force grinding operation should be terminated, cause the constant force grinding operation to be automatically terminated. The above-described predetermined threshold value V1 or ΔV1 is a value in vicinity of a point at which the rate of the reduction of the feed rate V is zeroed, for making it possible to automatically determine that the surface of the workpiece W has been completely flattened with unevenness (i.e., pits and projections) being eliminated.

Figure 14:
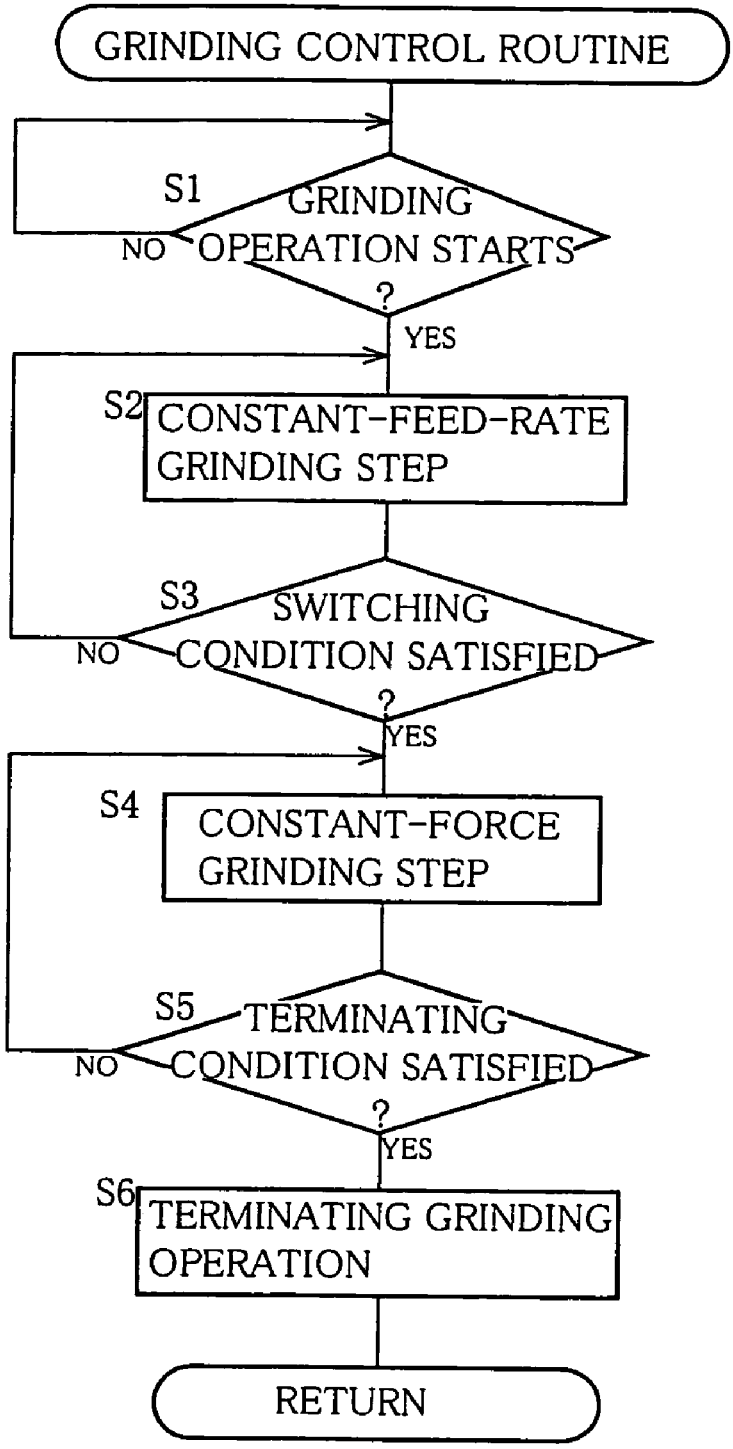
FIG. 14 is a flow chart illustrating a grinding control routine that is executed by the ECU of FIG. 9.

FIG. 14 is a flow chart illustrating a grinding control routine that is executed by the ECU 126. This routine is initiated with step S1 that is implemented to determine whether the automatic grinding operation by the surface grinder 10 should be started, by seeing whether a cycle start button (not shown) is placed in its ON state or not. Step S1 is repeatedly implemented until an affirmative decision (YES) is obtained in step S1. After the affirmative decision (YES) has been eventually obtained in step S1, step S2 corresponding to a constant feed-rate grinding step is implemented with the grinding-wheel feeding device 72 being placed in its constant feed-rate grinding mode. Step S2 is followed by step S3 in which the grinding load determining portion 144 is operated to determine whether the machining pressure P (i.e., pressing force or grinding load) has exceeded the predetermined threshold value P1, or whether the amount ΔP of change of the machining pressure P per a unit of time Δt has exceeded the predetermined threshold value ΔP1. That is, in step S3, it is determined whether a switching condition is satisfied or not. Until an affirmative decision (YES) is obtained in step S3, the steps S2 and S3 are repeatedly implemented, namely, the constant feed-rate grinding operation is continued. After the affirmative decision (YES) has been eventually obtained in step S3, step S4 corresponding to a constant force grinding step is implemented with the grinding-wheel feeding device 72 being placed in its constant force grinding mode by the switching portion 146. Step S4 is followed by step S5 in which the grinding termination determining portion 148 is operated to determine whether the actual feed rate V of the grinding wheel G has been reduced to be smaller than the predetermined threshold value V1 that is the value in vicinity of the point at which the rate of the reduction of the feed rate V is zeroed, or determine whether the amount ΔV of change of the feed rate V per a unit of time Δt has been reduced to be smaller than the predetermined threshold value ΔV1. That is, in step S5, it is determined whether a terminating condition is satisfied or not. Until an affirmative decision (YES) is obtained in step S5, the steps S4 and S5 are repeatedly implemented, namely, the constant force grinding operation is continued. After the affirmative decision (YES) has been eventually obtained in step S5, the grinding terminating portion 150 is operated to cause the constant force grinding operation to be automatically terminated, whereby the grinding operation by the surface grinder 10 is completed.

As described above, in the present embodiment, the constant feed-rate grinding step S2 is implemented by the constant feed-rate grinding portion 140 to grind the workpiece W by moving the grinding wheel G at a constant feed rate in the infeed direction, and then the constant force grinding step S4 is implemented by the constant force grinding portion 142 to grind the workpiece W by moving the grinding wheel G at a feed rate in the infeed direction, which rate is variable in a manner causing the grinding wheel G to be pressed against the workpiece W with a constant force. In this grinding process, the constant feed-rate grinding step S2 can be implemented with the grinding efficiency being given more importance than the quality of the ground workpiece, and the constant force grinding step S4 following the constant feed-rate grinding step S2 can be implemented with the quality of the ground workpiece being given more importance than the grinding efficiency. Thus, the grinding operation according to this grinding process can be carried out with a sufficiently high efficiency, and can provide a sufficiently high quality of the ground workpiece W.

Further, in the present embodiment, there are provided a grinding load detecting step implemented by the grinding load detector 122 to detect the grinding load during implementation of the constant feed-rate grinding step, and a switching step implemented by the switching portion 136 of the EUC 126 to switch the constant feed-rate grinding step S2 to the constant force grinding step S4, on the basis of the grinding load detected by the grinding load detector 122 in the grinding load detecting step, whereby the constant force grinding step can be started at a suitable point of time.

Further, in the present embodiment, there are provided a feed rate detecting step implemented by the grinding position detector 120 to detect the feed rate during implementation of the constant force grinding step, and a determining step implemented by the grinding termination determining portion 148 of the ECU 126 to determine whether the constant force grinding step should be terminated, on the basis of the feed rate detected by the grinding position detector 120 in the feed rate detecting step, whereby the constant force grinding step can be terminated at a suitable point of time, thereby preventing an excessive grinding of the workpiece W after the surface of the workpiece W has been completely flattened.

While the embodiment of the present invention has been described above for illustrative purpose only, it is to be understood that the present invention may be embodied with various changes and improvements, which may occur to those skilled in the art.

What is claimed is:

1. A process of grinding a surface of a workpiece, by a grinding tool rotated about an axis thereof, said process comprising:

a constant force grinding step of grinding the surface of the workpiece, by pressing at least one of the grinding tool and the workpiece against the other of the grinding tool and the workpiece, such that a constant force is exerted on said other of the grinding tool and the workpiece by said at least one of the grinding tool and the workpiece;

a constant feed-rate grinding step of grinding the surface of the workpiece, by moving said at least one of the grinding tool and the workpiece relative to said other of the grinding tool and the workpiece in an infeed direction that increases a depth of cut of the grinding tool into the workpiece, at a constant feed rate, wherein said constant feed-rate grinding step is implemented prior to implementation of said constant force grinding step;

a grinding load detecting step of detecting a grinding load acting on at least one of the grinding tool and the workpiece during implementation of said constant feed-rate grinding step; and a switching step of switching said constant feed-rate grinding step to said constant force grinding step, on the basis of said grinding load that is detected in said grinding load detecting step.

2. The process according to claim 1, further comprising: a feed-rate detecting step of detecting said feed rate during implementation of said constant force grinding step; and a determining step of determining whether said constant force grinding step should be terminated, on the basis of said feed rate detected in said feed-rate detecting step.

3. A process of grinding a surface of a workpiece, by a grinding tool rotated about an axis thereof, said process comprising:

a constant force grinding step of grinding the surface of the workpiece, by pressing at least one of the grinding tool and the workpiece against the other of the grinding tool and the workpiece, such that a constant force is exerted on said other of the grinding tool and the workpiece by said at least one of the grinding tool and the workpiece, said constant force grinding step being implemented by moving said at least one of the grinding tool and the workpiece relative to said other of the grinding tool and the workpiece in an infeed direction that increases a depth of cut of the grinding tool into the workpiece, at a feed rate that is variable in a manner causing said at least one of the grinding tool and the workpiece to be pressed against said other of the grinding tool and the workpiece with the constant force a feed-rate detecting step of detecting said feed rate during implementation of said constant force grinding step; and a determining step of determining whether said constant force grinding step should be terminated, on the basis of said feed rate detected in said feed-rate detecting step.

4. A grinding apparatus for performing a grinding operation in which a workpiece is ground at a surface thereof by a grinding tool rotated about an axis thereof, said grinding apparatus comprising:

a grinding-tool rotating device operable to rotate the grinding tool about said axis thereof;

a moving device operable to move at least one of the grinding tool and the workpiece relative to the other of the grinding tool and the workpiece, at least in an infeed direction that increases a depth of cut of the grinding tool into the workpiece;

a controller which controls said moving device, such that said at least one of the grinding tool and the workpiece is pressed against said other of the grinding tool and the workpiece, with a constant force at least in a non-initial stage of the grinding operation; and a grinding load detector operable to detect said grinding load acting on at least one of the grinding tool and the workpiece;

wherein said moving device is switchable between a constant feed-rate grinding mode and a constant force grinding mode, wherein said at least one of the grinding tool and the workpiece is moved by said moving device in said infeed direction at a constant feed rate, when said moving device is placed in said constant feed-rate grinding mode, wherein said at least one of the grinding tool and the workpiece is moved by said moving device in said infeed direction at a variable feed rate as said feed rate that causes the grinding tool to be pressed against the workpiece with a constant pressing force, when said moving device is placed in said constant force grinding mode, wherein said moving device is placed in said constant feed-rate grinding mode in a non-final stage of the grinding operation, and is placed in said constant force grinding mode in said non-initial stage following said non-final stage, and wherein said controller includes a switching portion operable to place said moving device in said constant force grinding mode, on the basis of said grinding load detected by said grinding load detector while said moving device is placed in said constant feed-rate grinding mode.

5. The grinding apparatus according to claim 4, further comprising a feed rate detector operable to detect said variable feed rate while said moving device is placed in said constant force grinding mode, wherein said controller includes a determining portion operable to determine whether the grinding operation should be terminated, on the basis of said variable feed rate detected by said feed rate detector.

* * * * *